US009045852B2

(12) United States Patent
Kim et al.

(10) Patent No.: US 9,045,852 B2
(45) Date of Patent: Jun. 2, 2015

(54) WASHING MACHINE AND WASHING CONTROL METHOD OF THE SAME

(75) Inventors: Hyun Sook Kim, Suwon-si (KR); Sung Hoon Kim, Suwon-si (KR); Seong Min Oak, Masan-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1271 days.

(21) Appl. No.: 11/727,386

(22) Filed: Mar. 26, 2007

(65) Prior Publication Data

US 2007/0289607 A1 Dec. 20, 2007

(30) Foreign Application Priority Data

Jun. 19, 2006 (KR) ..... 10-2006-0054932

(51) Int. Cl.

| | |
|---|---|
| ***D06F 33/00*** | (2006.01) |
| ***B08B 7/04*** | (2006.01) |
| ***D06F 35/00*** | (2006.01) |

(52) U.S. Cl.

CPC ..... *D06F 35/006* (2013.01); *D06F 2202/04* (2013.01); *D06F 2204/06* (2013.01)

(58) Field of Classification Search

CPC ..... A47L 15/4297; D06F 2204/02; D06F 2204/06; D06F 35/003; D06F 39/004; D06F 2202/04; D06F 35/006; D06F 37/203; D06F 37/304

USPC ..... 8/158, 159; 134/56 D, 57 D, 58 D, 18, 134/25.2; 68/12.02, 12.03, 12.12, 12.22, 68/12.27

See application file for complete search history.

(56) References Cited

U.S. PATENT DOCUMENTS

| | | | | | |
|---|---|---|---|---|---|
| 3,547,145 | A | * | 12/1970 | Holzer | 137/392 |
| 4,455,701 | A | | 6/1984 | Stehr et al. | |
| 5,299,340 | A | * | 4/1994 | Moon | 8/158 |
| 5,388,178 | A | * | 2/1995 | Moon | 392/444 |
| 5,449,884 | A | * | 9/1995 | Lee | 219/497 |
| 5,647,231 | A | * | 7/1997 | Payne et al. | 68/12.01 |

(Continued)

FOREIGN PATENT DOCUMENTS

| | | |
|---|---|---|
| DE | 100 54 957 | 5/2002 |
| DE | 100 54 957 A1 | 5/2002 |

(Continued)

OTHER PUBLICATIONS

Office Action for corresponding Chinese Application 200710104492.9; issued Mar. 20, 2009.

(Continued)

*Primary Examiner* — Michael Kornakov
*Assistant Examiner* — Katelyn Whatley
(74) *Attorney, Agent, or Firm* — Staas & Halsey LLP

(57) ABSTRACT

A washing machine and a washing control method of the same capable of controlling a degree of application of the machine force at every temperature step according to the selected washing course based on information, such as the amount of load detected in the beginning of washing and the amount of wash water detected by the rise change of the wash water temperature during washing, thereby reducing damage to laundry during washing and accomplishing optimal washing efficiency. The washing control method includes detecting wash water temperature and controlling a motor operation rate or a washing time based on the detected wash water temperature.

6 Claims, 9 Drawing Sheets

(56) References Cited

U.S. PATENT DOCUMENTS

| | | | | |
|---|---|---|---|---|
| 6,044,510 | A * | 4/2000 | Cho | 8/158 |
| 6,499,321 | B1 * | 12/2002 | Rhodes et al. | 68/12.03 |
| 6,523,370 | B1 * | 2/2003 | Broker et al. | 68/12.21 |
| 7,062,863 | B2 * | 6/2006 | Chung | 34/596 |
| 2004/0098811 | A1 * | 5/2004 | Tuttle et al. | 8/158 |
| 2005/0034250 | A1 * | 2/2005 | Oh et al. | 8/159 |
| 2005/0034491 | A1 * | 2/2005 | Tazawa et al. | 68/12.03 |
| 2006/0000029 | A1 * | 1/2006 | Park | 8/158 |
| 2006/0101587 | A1 * | 5/2006 | Hong | 8/149.1 |
| 2006/0191077 | A1 * | 8/2006 | Oh et al. | 8/158 |
| 2007/0005190 | A1 * | 1/2007 | Feinleib et al. | 700/275 |
| 2007/0220683 | A1 * | 9/2007 | Kim | 8/158 |
| 2008/0115539 | A1 * | 5/2008 | Nishino et al. | 68/12.03 |

FOREIGN PATENT DOCUMENTS

| | | | | | |
|---|---|---|---|---|---|
| DE | 10054957 | A1 * | 5/2002 | | A47L 15/42 |
| EP | 0 031 016 | | 7/1981 | | |
| EP | 0 031 016 | A1 | 7/1981 | | |
| EP | 31016 | A1 * | 7/1981 | | D06F 35/00 |
| EP | 1306044 | A1 * | 5/2003 | | |
| GB | 2 191 216 | A | 12/1987 | | |
| KR | 1986-0003378 | | 5/1986 | | |
| KR | 1999-017971 | | 3/1999 | | |
| KR | 1019990017971 | * | 3/1999 | | |
| WO | WO 2004106614 | A1 * | 12/2004 | | D06F 33/02 |
| WO | 2005/064063 | A | 7/2005 | | |
| WO | WO 2006071022 | A1 * | 7/2006 | | |

OTHER PUBLICATIONS

European Search Report issued Oct. 12, 2007 is corresponding European Patent Application No. 07105214.6-2314.

* cited by examiner

WASHING MACHINE AND WASHING CONTROL METHOD OF THE SAME

CROSS-REFERENCE TO RELATED APPLICATIONS

This application claims the benefit of Korean Patent Application No. 10-2006-0054932, filed on Jun. 19, 2006 in the Korean Intellectual Property Office, the disclosure of which is incorporated herein by reference.

BACKGROUND OF THE INVENTION

1. Field of the Invention

The present invention relates to a washing machine and a washing control method of the same. More particularly, to a washing machine and a washing control method of the same that is capable of controlling laundry to be effectively washed depending upon load of the washing machine and the amount of wash water.

2. Description of the Related Art

Generally, a conventional washing machine (for example, a drum type washing machine) is a machine that washes laundry by lifting and dropping the laundry in a cylindrical rotary drum during rotation of the drum. The drum type washing machine has washing time longer than a conventional pulsator type washing machine. However, the drum type washing machine has advantages in that damage to laundry is low, and the amount of water consumed is small. For this reason, the demand of the drum type washing machine has increased.

The conventional drum type washing machine detects the weight of laundry (i.e., the amount of load) in the beginning of washing to decide the amount of wash water, after a user selects a washing course, and performs a washing operation with an operation rate (i.e., motor-on/off time) and a washing time set for each weight of the laundry based on the selected washing course.

However, the amount of water absorbed by the laundry varies depending upon the material of the laundry (for example, towels or blue jeans), although the weight of the laundry is the same. As a result, the amount of wash water varies depending upon the material of the laundry during washing, and therefore, in the case of heated washing, time necessary for wash water temperature to rise to a desired wash water temperature varies.

In a conventional washing method, however, algorithm is executed, in the beginning of washing, based on an operation rate and washing time set for the weight of each dried laundry based on each washing course without consideration of the rise change of the wash water temperature generated due to the change in the amount of wash water depending upon the difference in material of the laundry. Consequently, in the case of heated washing, the same algorithm is executed irrespective of initial water temperature, the change of the wash water temperature, or the rise rate of the wash water temperature. As a result, it is not possible to achieve optimal heating and machine force application in consideration of the change in the amount of wash water, the temperature of laundry, and the change of the wash water temperature.

Furthermore, a conventional system to execute the algorithm based on the difference of the operation rate and washing time set for each load based on a washing course through detection of the weight of the laundry is applied in the case of a washing course that is capable of washing a large amount of laundry. However, in the case of a washing course that is capable of washing only a small amount of laundry (for example, a delicate washing course or a rapid washing course), an algorithm additionally set for each load is not provided, and therefore, the same algorithm is executed irrespective of the weight of laundry, the amount of wash water, and the temperature of wash water. As a result, laundry, such as wool or silk, requiring delicate washing may be damaged due to non-uniform wash water temperature.

SUMMARY OF THE INVENTION

Accordingly, it is an aspect of the present invention to provide a washing machine and a washing control method of the same which is capable of controlling a degree of application of the machine force at every temperature step according to the selected washing course based on information, such as an amount of load detected in a beginning of washing (i.e., an initial operation of washing) and an amount of wash water detected by the rise change of the wash water temperature during washing, thereby reducing damage to laundry during washing and accomplishing optimal washing efficiency.

It is another aspect of the present invention to provide a washing machine and a washing control method of the same that is capable of detecting initial washing temperature and the change of wash water temperature in a heating section which is an area surrounding a washer heater of the washing machine, thereby accomplishing uniform mixture of wash water during heating of the wash water and reducing damage to laundry.

It is yet another aspect of the present invention to provide a washing machine and a washing control method of the same that is capable of achieving optimal heating and machine force application every temperature step in consideration of a load of the washing machine and the rise rate of the wash water temperature generated due to the change in the amount of wash water depending upon the difference in material of laundry.

Additional aspects and/or advantages of the invention will be set forth in part in the description which follows and, in part, will be apparent from the description, or may be learned by practice of the invention.

The foregoing and/or other aspects of the present invention are achieved by providing a washing control method of a washing machine, the method including detecting a wash water temperature, and controlling a motor operation rate and a washing time based on the detected wash water temperature.

According to an aspect of the present invention, the detecting wash water temperature includes detecting the temperature of wash water supplied in an initial operation of washing, and the controlling the motor operation rate or the washing time includes comparing the temperature of wash water supplied in the initial operation of washing with a predetermined reference water temperature to decrease a motor-on time and the washing time when the initial wash water temperature is higher than the reference water temperature and to increase the motor-on time and the washing time when the initial wash water temperature is lower than the reference water temperature.

According to another aspect of the present invention, the detecting wash water temperature includes detecting a drop of the wash water temperature during a motor-off time, and the controlling the motor operation rate or washing time includes checking the drop of the wash water temperature during the motor-off time to decrease the motor-off time, when the temperature drop has occurred for more than a predetermined time.

According to yet another aspect of the present invention, the detecting wash water temperature includes detecting a rise rate of the wash water temperature depending upon a material of laundry, and the controlling motor operation rate or washing time includes comparing a rise rate of the wash water temperature and a predetermined reference rise rate of the wash water temperature to decrease a motor-on time and the washing time, when the rise rate of the wash water temperature is higher than the reference rise rate of the wash water temperature, and to increase the motor-on time and the washing time when the rise rate of the wash water temperature is lower than the reference rise rate of the wash water temperature.

According to yet another aspect of the present invention, the detecting wash water temperature includes detecting a wash water temperature variation during washing, and the controlling the motor operation rate or the washing time includes changing a motor-on time at every temperature step based on the variation of the wash water temperature.

The changing the motor-on time at every temperature step includes decreasing the motor-on time to decrease a machine force as the wash water temperature rises during delicate washing and increasing the motor-on time to increase the machine force as the wash water temperature rises during normal washing.

The washing control method further includes setting a reference motor operation rate and a reference washing time based on a weight of laundry, and the controlling the motor operation rate or washing time includes changing the set reference motor operation rate and the set reference washing time based on the wash water temperature.

The washing control method further includes allowing a user to select a washing course, and the setting the reference motor operation rate and the reference washing time includes acquiring a reference motor operation rate and a reference washing time set for each weight of the laundry based on the selected washing course.

The detecting wash water temperature includes one of detecting the temperature of wash water supplied in an initial operation of washing, detecting the drop of the wash water temperature during the motor-off time, detecting the rise rate of the wash water temperature depending upon material of laundry, and detecting the wash water temperature variation during washing.

The detecting the drop of the wash water temperature during the motor-off time includes detecting the wash water temperature during the motor-off time, to check a temperature drop in which a wash water temperature rising and dropping continues for a predetermined period of time.

The detecting the rise rate of the wash water temperature includes checking the change of the wash water temperature rising for a predetermined period of time during washing.

It is another aspect of the present invention to provide a washing control method of a washing machine, the method including detecting initial wash water temperature and a change of wash water temperature in a heating section which is an area surrounding a washer heater of the washing machine, changing a motor operation rate or a washing time based on the initial wash water temperature, and controlling the changed motor operation rate or washing time based on the change of the wash water temperature in the heating section.

It is another aspect of the present invention to provide a washing machine having a motor, the washing machine including a temperature sensor to detect a wash water temperature, and a control unit to control a motor operation rate or a washing time based on the detected wash water temperature.

The washing machine further includes a signal input unit to select a washing course, and the control unit acquires a reference motor operation rate and a reference washing time set for each weight of the laundry based on the selected washing course to control the motor operation rate or the washing time during washing.

The temperature sensor detects one of a temperature of wash water supplied in an initial operation of washing, a drop of the wash water temperature during a motor-off time, a rise rate of the wash water temperature during washing, and a change of the wash water temperature during washing.

It is yet another aspect of the present invention to provide a washing machine having a motor and a washer heater, the washing machine including a temperature sensor to detect an initial wash water temperature and a change of wash water temperature in a heating section which is an area surrounding the washer heater, and a control unit to control a motor operation rate or a washing time based on the detected initial wash water temperature and the detected change of the wash water temperature.

According to an aspect of the present invention, the control unit changes the motor operation rate or the washing time based on the detected initial wash water temperature and controls the changed motor operation rate or washing time based on the change of the wash water temperature in the heating section.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
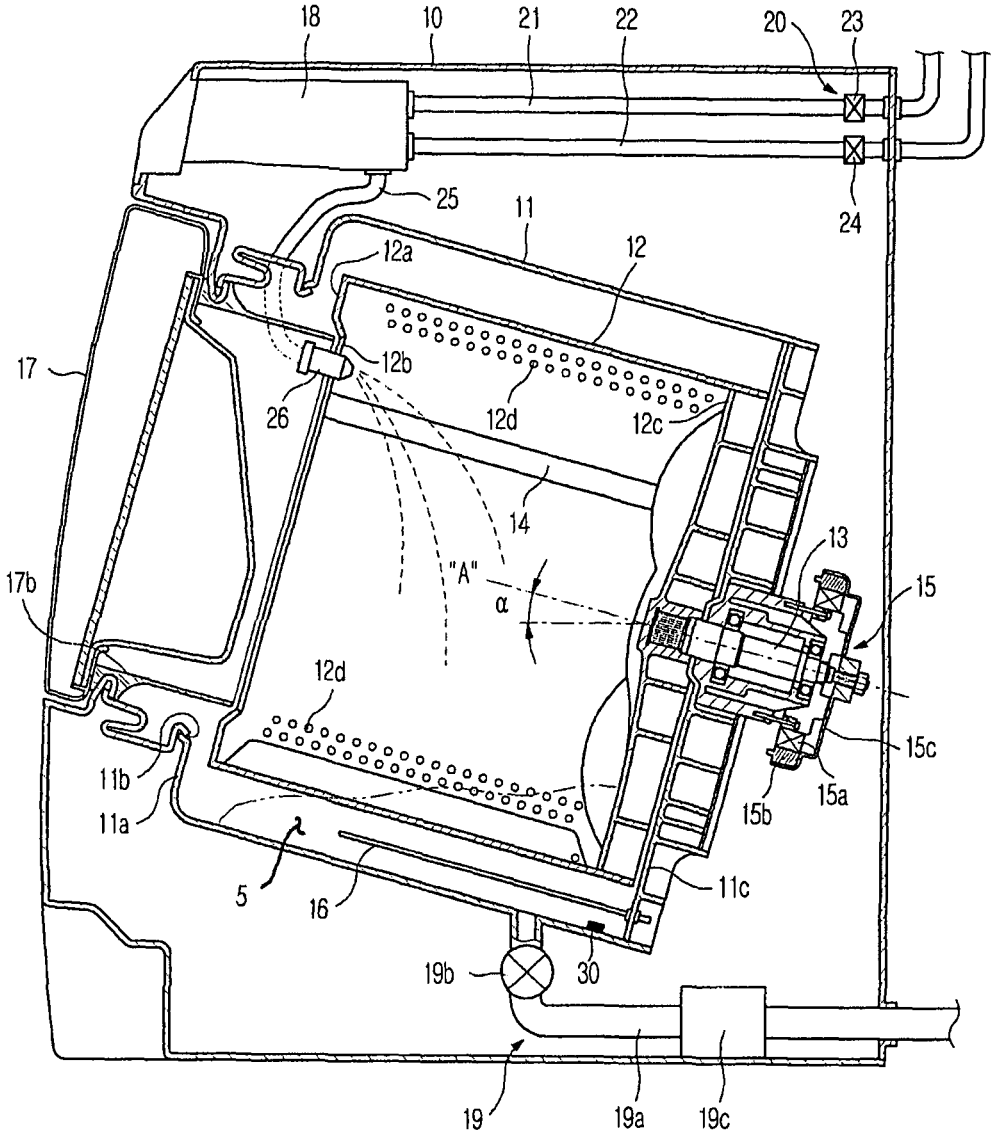
FIG. 1 is a sectional view illustrating a washing machine according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a sectional view illustrating a washing machine according to an embodiment of the present invention.

As shown in FIG. 1, the washing machine comprises a drum-type water tub 11 mounted in a machine body 10 to receive wash water and a rotary drum 12 rotatably mounted in the tub 11.

The tub 11 is mounted at a predetermined angle α from an installation surface of the washing machine such that a front part 11*a* having an inlet 11*b*, of the tub 11 is higher than a rear part 11*c* of the tub 11. The drum 12 is also mounted in the same manner as the tub 11 such that a front part 12*a* having an inlet 12*b*, of the drum 12 is higher than a rear part 12*c* of the drum 12.

Specifically, a rotary center line "A" of the drum 12 is placed at the predetermined angle α from the installation surface of the washing machine such that the front part 12*a* of the drum 12 faces the upper front. Also, a rotary shaft 13, which is coupled with a center of the rear part 12*c* of the drum 12, is rotatably supported at a center of the rear part of the tub 11 such that the drum 12 can be rotated in the tub 11.

The drum 12 comprises a plurality of through-holes 12*d* at a circumference thereof. Also, a plurality of lifters 14 are attached to an inner surface of the drum 12, to lift laundry during a rotation of the drum 12.

A motor 15 is mounted at an outside of the rear part 11*c* of the tub 11, to rotate the rotary shaft 13 connected with the drum 12 such that washing, rinsing, and spin-drying operations can be performed. Further, a washing heater 16 is mounted inside the lower part of the tub 11 to heat wash water supplied to the tub 11 and an area surrounding the washer heater 16 is a heating section 5. In addition, a temperature sensor 30 is also mounted inside the lower part of the tub 11, to detect the temperature of wash water in the tub 11.

In an embodiment of the present invention, the temperature sensor 30 is mounted inside the lower part of the tub 11 as described above. However, the position of the temperature sensor 30 is not limited thereto, and therefore, the temperature sensor 30 may be mounted at any position so long as the temperature of wash water can be detected by the temperature sensor 30.

The motor 15 comprises a stator 15*a* fixed with the rear part 11*c* of the tub 11, a rotor 15*b* rotatably disposed around the stator 15*a*, and a rotary plate 15*c* to connect the rotor 15*b* and the rotary shaft 13.

An inlet 17*b* is formed in the front part of the machine body 10, corresponding to the inlet 12*b* of the drum 12 and the inlet 11*b* of the tub 11 such that laundry can be put into or removed from the drum 12 through the inlet 17*b*. The inlet 17*b* is opened and closed by a door 17 hingedly connected with the front part of the machine body 10.

Above the tub 11, are mounted a detergent supply unit 18 to supply detergent to the tub 11 and a water supply unit 20 to supply wash water to the tub 11. Below the tub 11 is mounted a drainage unit 19 to drain water from the tub 11. The drainage unit 19 comprises a draining pipe 19*a*, a draining valve 19*b*, and a draining pump 19*c*.

The interior of the detergent supply unit 18 is partitioned into a plurality of spaces. The detergent supply unit 18 is mounted adjacent to the front part of the machine body 10 such that a user can easily put detergent and rinse into the respective partitioned spaces. The partitioned spaces comprise a preliminary washing detergent compartment to store detergent to be used for a preliminary washing operation, a main washing detergent compartment to store detergent to be used for a main washing operation, and a rinse compartment to store rinse to be used for a rinsing operation. The partitioned spaces of the detergent supply unit 18 is disclosed in Korean Patent Application No. 2003-0011317, which has been filed in the name of the assignee of the present patent application. However, the interior of the detergent supply unit 18 may be partitioned according to a conventional art.

The water supply unit 20 comprises cold water and hot water supply pipes 21 and 22 to supply cold wash water and hot wash water to the tub 11, and water supply valves 23 and 24 mounted on the cold water and hot water supply pipes 21 and 22, to control the supply of wash water through the cold water and hot water supply pipes 21 and 22.

The cold water and hot water supply pipes 21 and 22 are connected to the detergent supply unit 18 such that water supplied from an outside can be supplied to the detergent supply unit 18. Between the detergent supply unit 18 and the tub 11 is mounted an additional water supply pipe 25, to supply water having passed through the detergent supply unit 18 to the tub 11. At the outlet of the water supply pipe 25 is mounted a water supply nozzle 26. Consequently, water passes through the detergent supply unit 18 while the water is supplied to the tub 11, and therefore, detergent stored in the detergent supply unit 18 is supplied to the tub 11.

Figure 2:
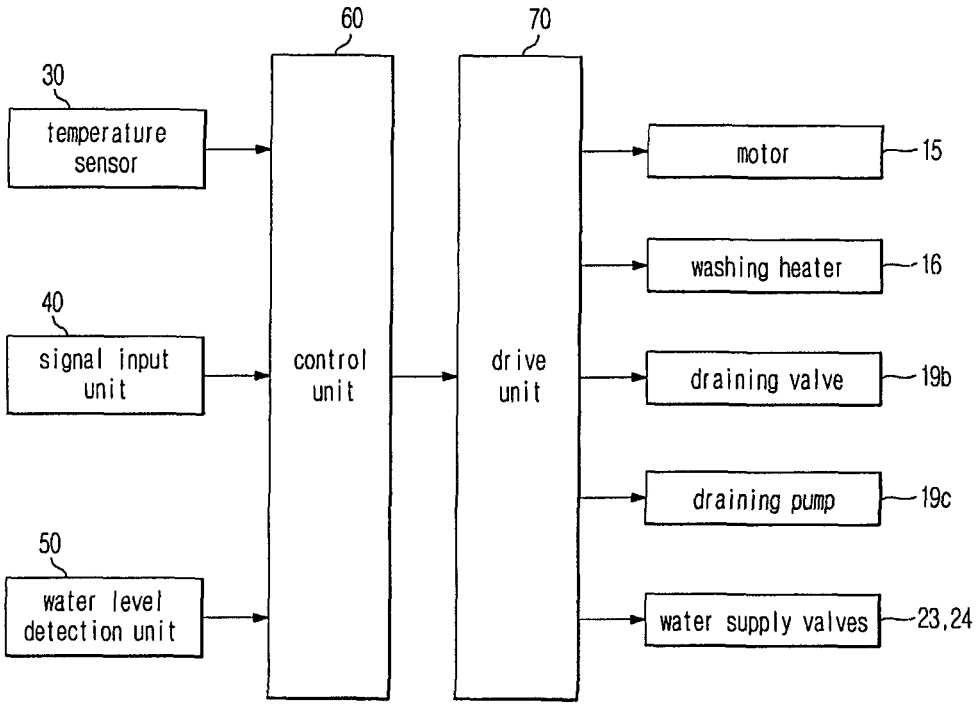
FIG. 2 is a control block diagram of a washing control unit of the washing machine shown in FIG. 1, according to an embodiment of the present invention.

FIG. 2 is a control block diagram of a washing control unit of the washing machine shown in FIG. 1, according to an embodiment of the present invention. The washing machine further comprises a signal input unit 40, a water level detection unit 50, a control unit 60, and a drive unit 70, in addition to the components shown in FIG. 1.

The signal input unit 40 inputs operation information, such as a washing course (for example, a delicate washing course or a normal washing course), washing temperature, spin-drying velocity (rpm), and rinsing, selected by a user depending upon material of laundry to the control unit 60.

The water level detection unit 50 detects the level of wash water supplied to the tub 11. Since the amount of water absorbed by laundry varies depending upon the material of the laundry, the water level detection unit 50 detects water level in the tub varying depending upon the amount of wash water changed during a washing process and inputs the detected water level data to the control unit 60.

The control unit 60 is a microcomputer to control the washing machine based on operation information inputted from the signal input unit 40. The control unit 60 stores the amount of wash water, motor operation rate (reference motor-on time (As) and motor-off time (Bs)), a reference washing time (Cs) set depending upon the amount of load (i.e., weight of laundry) in the selected washing course.

The control unit 60 detects the temperature (i.e., an initial water temperature) of wash water supplied in the initial operation of washing and changes the reference motor-on time (As) and the reference washing time (Cs) set depending upon the amount of load (i.e., weight of laundry) in the selected washing course according to the initial water temperature (first algorithm change).

Specifically, when the initial water temperature (To) deviates from a predetermined reference water temperature range (To1) to (To2) (10 to 30°), i.e., (To) is higher than (To2), the control unit 60 decreases the reference motor-on time (As) and the reference washing time (Cs) so as to reduce damage to laundry and save energy. When the initial water temperature (To) deviates from a predetermined reference water temperature range (To1) to (To2) (10 to 30°), i.e., (To) is lower than (To1), the control unit 60 increases the reference motor-on time (As) and the reference washing time (Cs) so as to achieve optimal washing efficiency.

Also, the control unit 60 resets the motor-off time (Bs) set depending on the amount of load (i.e., weight of laundry) in the washing course based on a section where there occurs the point of time when the wash water temperature detected in the lower part of the washing machine rises and then drops in consideration of the fact that, in the case of a delicate washing course (a washing course performed to mainly reduce damage to laundry), which requires a large amount of wash water as compared to the weight of laundry, temperature change in the lower part of the tub 11 occurs due to convection generated by heating the wash water (second algorithm change).

Figure 4A:
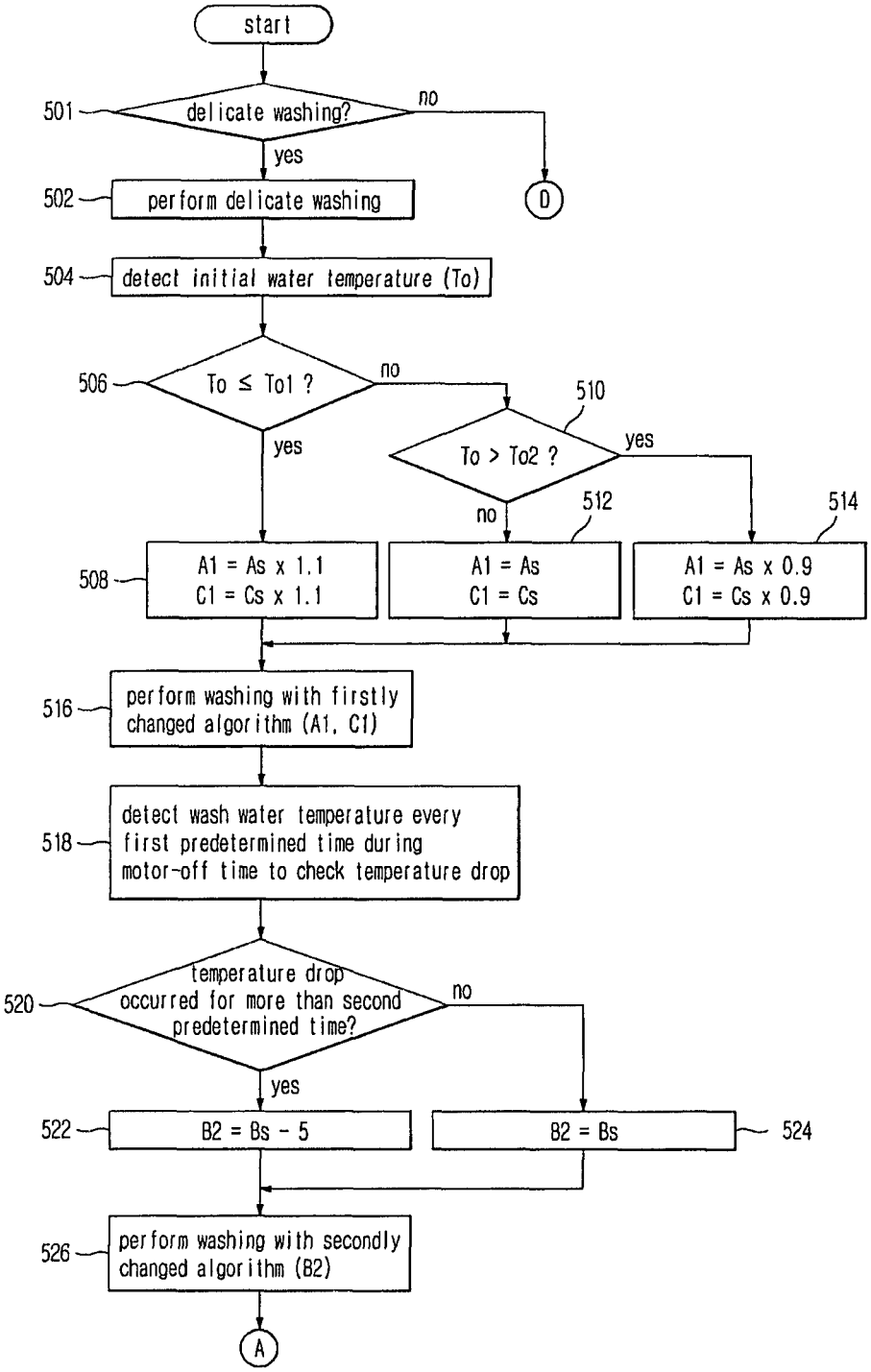
FIGS. 4A and 4B are flow charts illustrating a washing control method based on temperature detection in a delicate washing course of the washing machine according to an embodiment of the present invention.

For example, the control unit 60 detects the wash water temperature a predetermined number of times (approximately once) every first predetermined time (approximately 1 second) during the motor-off time (Bs) to check temperature drop. When the temperature drop has occurred for more than a second predetermined time (for example, approximately 5 seconds), the control unit 60 resets the motor-off time (Bs), such that the motor-off time (Bs) is shortened (B2 as shown in FIG. 4A, operation 522), so as to solve a problem in that high-temperature water is partially brought into contact with laundry requiring delicate washing and accomplish uniform mixture of wash water during heating of the wash water, thereby maximally reducing damage to the laundry.

Since the amount of water absorbed by laundry varies depending upon the material of the laundry (for example, towels or blue jeans), although the weight of the laundry is the same, while the washing is performed based on the algorithm (motor-on time (A1) and washing time (C1)) firstly changed depending upon the initial water temperature (To) or the algorithm (motor-off time (B2)) secondly changed depending upon the temperature drop, the control unit 60 also detects the wash water temperature for a predetermined time (i.e., a minimum time for which the rise rate of the wash water temperature can be detected) during washing, in consideration of the fact that time necessary for wash water temperature to rise to a desired wash water temperature varies as the amount of wash water varies during washing, so as to detect the rise rate (Wa) of the wash water temperature rising with time and reset the motor-on time (A1) and the washing time (C1) first changed depending upon the initial water temperature (To) based on the detected rise rate (Wa) of the wash water temperature (third algorithm change).

Specifically, when the rise rate (Wa) of the wash water temperature is higher than a predetermined reference rise rate range (Wa1) to (Wa2) (1 to 30 per minute), which means that a large amount of wash water has been absorbed by the laundry, and therefore, the amount of wash water is small, the control unit 60 decreases the motor-on time A1 and the washing time (C1) first changed depending upon the initial water temperature (To) so as to reduce damage to laundry and save energy. When the rise rate (Wa) of the wash water temperature is lower than the reference rise rate range (Wa1) to (Wa2), which means that a small amount of wash water has been absorbed by laundry, and therefore, the amount of wash water is large, the control unit 60 increases the motor-on time (A1) and the washing time (C1) first changed depending upon the initial water temperature (To) so as to achieve optimal washing efficiency.

In the case of heated washing, the control unit 60 also detects wash water temperature (Tw), while the washing is performed based on the algorithm (motor-on time (A3) and washing time (C3)) thirdly changed depending upon the rise rate (Wa) of the wash water temperature, so as to reset motor-on time (A4) at every temperature step depending upon the change of the wash water temperature (Tw). In this case, the control unit 60 controls a degree of application of a machine force depending upon the washing course (the delicate washing or the normal washing) (fourth algorithm change).

Specifically, in the case of a delicate washing course (i.e., a washing course performed to mainly reduce damage to laundry), which requires a large amount of wash water as compared to the weight of laundry, the control unit 60 performs an algorithm in which the motor-on time (A4) is decreased to reduce the machine force as the wash water temperature (Tw) rises, thereby reducing the damage to laundry.

On the other hand, in the case of a normal washing course (i.e., a washing course performed to mainly improve washing efficiency), which requires a small amount of wash water as compared to the weight of laundry, the control unit 60 performs an algorithm in which the motor-on time (A3) is increased to increase the machine force as the wash water temperature (Tw) rises, thereby maximally improving the washing efficiency.

As shown in FIG. 2, the drive unit 70 drives the motor 15, the washing heater 16, the draining valve 19*b*, the draining pump 19*c*, and the water supply valves 23 and 24 based on a drive control signal from the control unit 60.

Hereinafter, the operation of the washing machine with the above-stated construction and a washing control method of the washing machine will be described.

The washing control method of the washing machine according to an embodiment of the present invention is performed to change the motor operation rate and the washing time depending upon the initial wash water temperature and the change of the wash water temperature in the heating section 5, thereby accomplishing uniform mixture of wash water and reducing damage to laundry. The washing control method will be described in detail with reference to FIGS. 3-6B.

Figure 3:
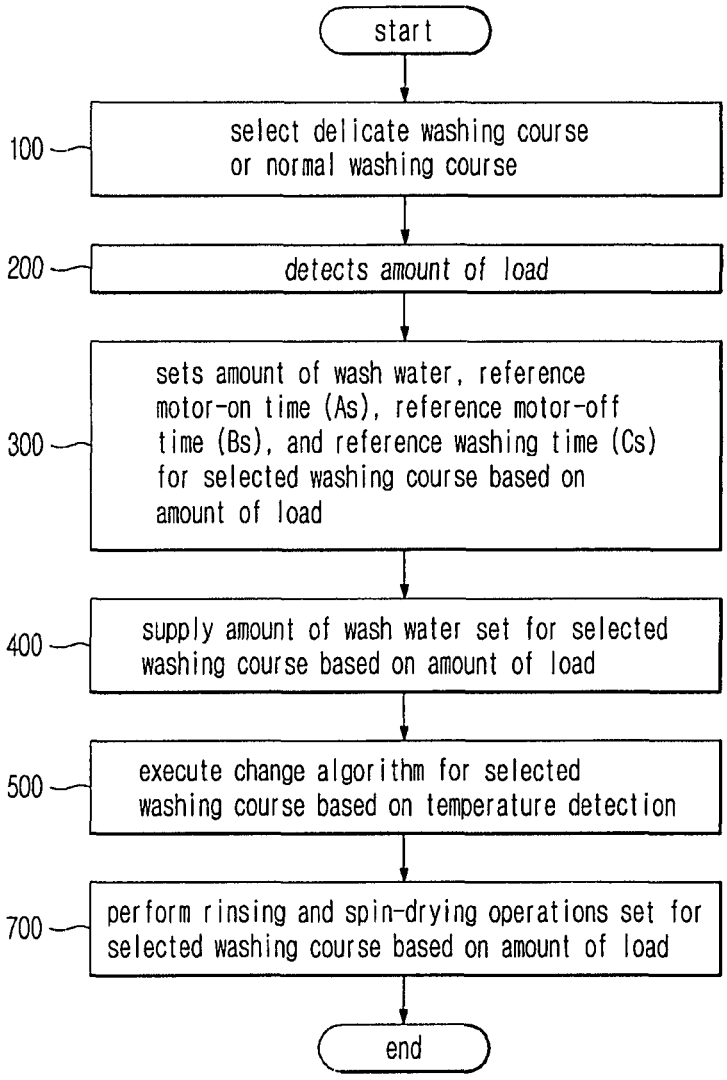
FIG. 3 is a flow chart illustrating a washing control method based on temperature detection in the washing machine according to an embodiment of the present invention.

FIG. 3 is a flow chart illustrating a washing control method based on temperature detection in the washing machine according to the present invention.

In operation 100, when a user puts laundry in the drum 12 and selects operation information, such as a washing course (a delicate washing course or a normal washing course), washing temperature, spin-drying velocity (rpm), and rinsing, based on material of the laundry the operation information selected by the user is inputted to the control unit 60 through the signal input unit 40.

Consequently, the control unit 60 starts to perform a washing operation based on the operation information inputted from the signal input unit 40. First, in operation 200, the control unit 60 detects the amount of load (i.e., the weight of the laundry) put in the drum 12 and from operation 200, the process moves to operation 300, where the control unit sets the amount of wash water, the reference motor-on time (As), the motor-off time (Bs), and the reference washing time (Cs) for the selected washing course based on the amount of load detected.

Subsequently, from operation 300, the process moves to operation 400, where the control unit 60 controls the water supply unit 20 to be operated such that the amount of wash water set for the selected washing course depending upon the amount of load can be supplied. As a result, the water supply valves 23 and 24 are opened, the wash water is supplied to the tub 11 through the water supply pipes 21 and 22, the detergent supply unit 18, the water supply pipe 25, and the water supply nozzle 26.

During the supply of wash water for washing, the control unit 60 detects the wash water temperature (i.e., an initial water temperature) at the time of initial washing and changes the reference motor-on time (As) and the reference washing time (Cs) set depending upon the amount of load. Subsequently, from operation 400, the process moves to operation 500, where the control unit 60 detects the wash water temperature in the heating section 5 during washing and executes change algorithm to reset the motor operation rate and the washing time changed based on the initial water temperature.

The algorithm, according to an embodiment of the present invention, is executed to change the motor operation rate and the washing time based on the temperature detection is to accomplish uniform mixture of wash water and reduce damage to the laundry. Furthermore, the reason is to accomplish optimal heating and machine force application at every temperature step in consideration of the rise rate of the wash water temperature generated due to the change in the amount of wash water depending upon the difference in material of the laundry.

After the change algorithm for the selected washing course based on the temperature detection is executed to perform the washing operation, the process moves to operation 700 where rinsing and spin-drying operations set for the selected washing course based on the amount of load are performed.

Hereinafter, the process for executing the change algorithm for the selected washing course based on the temperature detection in operation 500, which is the technical characteristic of an embodiment of the present invention, will now be described with reference to FIGS. 4A, 4B, 5A and 5B.

First, a method of executing algorithm to change the motor operation rate and the washing time based on the temperature detection when the user selects the delicate washing course will be described with reference to FIGS. 4A and 4B.

Figure 4B:
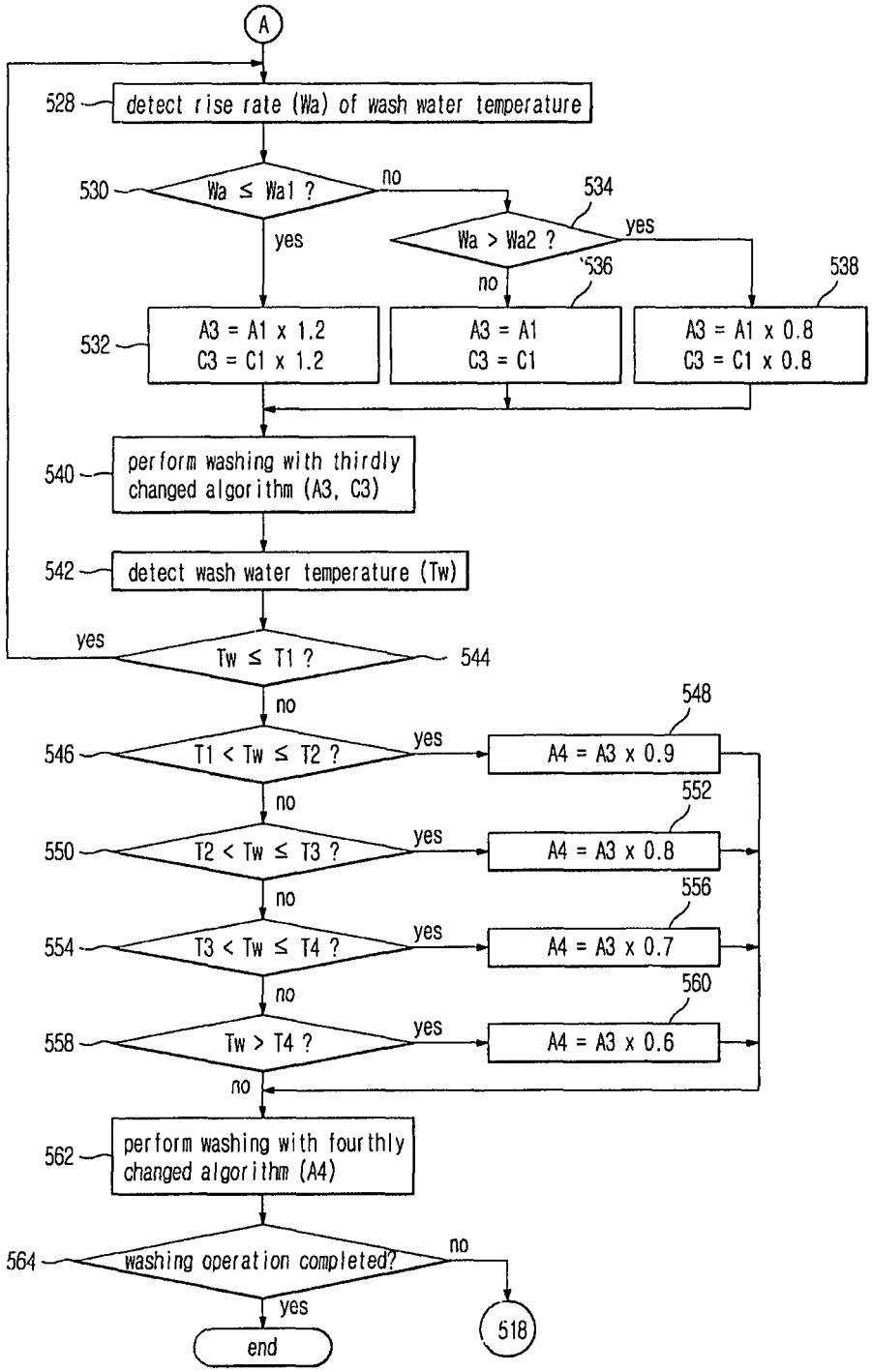

FIGS. 4A and 4B are flow charts illustrating a washing control method based on temperature detection in a delicate washing course of the washing machine according to the present invention.

As shown in FIG. 4A, in operation 501, it is determined whether the washing course selected by the user is a delicate washing course. When it is determined that the selected washing course is the delicate washing course in operation 501, the process moves to operation 502 where a washing operation of the delicate washing course is initiated based on the reference motor-on time (As), the motor-off time (Bs), and the reference washing time (Cs) set depending upon the amount of load (i.e., weight of the laundry).

When the washing operation of the delicate washing course is initiated in operation 502, the process moves to operation 504, where the control unit 60 detects the temperature of wash water supplied in the beginning of washing (i.e., an initial water temperature) (To) through the temperature sensor 30 and compares the detected temperature with the predetermined reference water temperature range (To1) to (To2) (10 to 30°).

From operation 504, the process moves to operation 506, where it is determined whether the detected initial water temperature (To) is less than or equal to (To1). When it is determined that in operation 506 that the detected initial water temperature (To) deviates from the reference water temperature range (To1) to (To2), (i.e., (To) is lower than (To1), the process moves to operation 508, where the control unit 60 increases motor-on time (A1) (i.e., As×1.1) and washing time (C1) (i.e., Cs×1.1), which are obtained by multiplying the reference motor-on time (As) and the reference washing time (Cs) by 1.1 such that optimal washing is accomplished even when the wash water temperature is low.

In operation 510, when the initial water temperature (To) is within the reference water temperature range (To1) to (To2), the process moves to operation 512, where the motor-on time (A1) and the washing time (C1) of the next algorithm are set to satisfy A1=As and C1=Cs without changing the reference motor-on time (As) and the reference washing time (Cs).

On the other hand, when the initial water temperature (To) deviates from the reference water temperature range (To1) to (To2) (i.e., (To) is higher than (To2)) in operation 510, the process moves to operation 514, where the control unit 60 decreases the motor-on time (A1) (i.e., As×0.9) and the washing time (C1) (i.e., Cs×0.9), which are obtained by multiplying the reference motor-on time (As) and the reference washing time (Cs) by 0.9 such that energy is saved with reduced damage to laundry when the wash water temperature is high.

Thus, from operations 508, 512 or 514, the process moves to operation 516, where the washing is performed with the algorithm firstly changed based on the initial water temperature (To). In the case of the delicate washing course performed to mainly reduce damage to the laundry, however, temperature change in the lower part of the tub 11 and the wash water temperature at respective positions in the tub 11 and the change of the wash water temperature fluctuate due to convection of the wash water generated by increasing the motor-off time even when the same amount of wash water is heated, and therefore, the wash water temperature in the tub 11 becomes higher than the wash water temperature in the lower part of the tub 11. As a result, the laundry may be partially brought into contact with the high-temperature water.

Figure 6A:
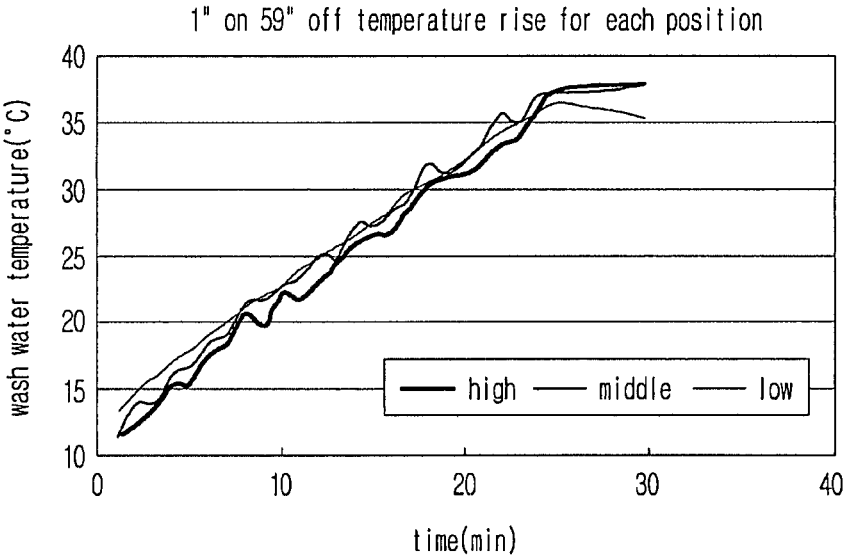
FIGS. 6A and 6B are distribution charts illustrating the increase of wash water temperature based on the motor off-time difference in the delicate washing course of the washing machine according to an embodiment of the present invention.
Figure 6B:
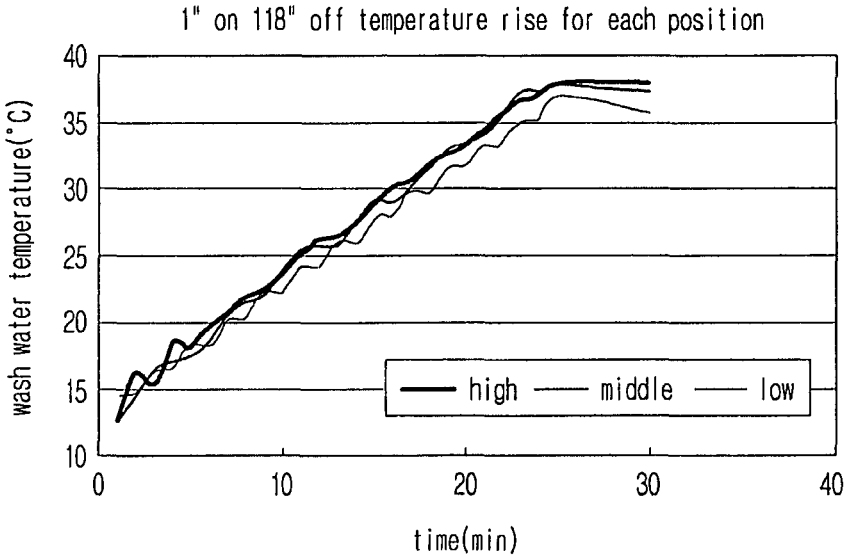

Consequently, from operation 516, the process moves to operation 518, where the control unit 60 detects the wash water temperature a predetermined number of times (approximately once, for example) every first predetermined time (approximately 1 second, for example) during the motor-off time (Bs) to check temperature drop at the point of time when the wash water temperature detected in the lower part of the washing machine rises and then drops, as shown in FIGS. 6A and 6B.

From operation 518, the process moves to operation 520, where it is determined whether the checked temperature drop has occurred for more than a second predetermined time. When it is determined that the checked temperature drop has occurred for more than the second predetermined time (approximately 5 seconds, for example) in operation 520, the process moves to operation 522, where the control unit 60 resets the motor-off time (B2), such that the motor-off time (B2) is shortened by subtracting the second predetermined time (5 seconds) from the motor-off time (Bs) set depending upon the amount of load. When it is determined that the temperature drop does not occur for more than the second predetermined time (approximately 5 seconds) in operation 520, the process moves to operation 524, where the motor-off time of the next algorithm is set to satisfy B2=Bs without changing the motor-off time (Bs) set depending upon the amount of load.

As shown in FIGS. 6A and 6B, the water temperature in the tub 11 is lower than the water temperature in the lower part of the tub 11 having the heater 16 positioned adjacent thereto, and therefore, normal temperature distribution is accomplished during heating of the wash water in FIG. 6A having a motor-off time (B2) of 59 seconds as compared to FIG. 6B having a motor-off time (B2) of 118 seconds.

From operation 522 and operation 524, the process moves to operation 526, where while the washing is performed based on the algorithm (the motor-on time (A1) and the washing time (C1)) firstly changed depending upon the initial water temperature (To) or the algorithm (the motor-off time (B2)) secondly changed depending upon the temperature drop generated during the motor-off time as described above, the amount of water absorbed by laundry varies depending upon the material of the laundry (for example, towels or blue jeans), although the amount of load (weight of the laundry) is the same, and therefore, the amount of wash water varies during washing. Since time necessary for wash water temperature to rise to a desired wash water temperature varies due to the change of the amount of wash water, the control unit 60 detects the wash water temperature for a predetermined time (i.e., a minimum time for which the rise rate of the wash water temperature can be detected) during washing.

Subsequently, from operation 526 (shown in FIG. 4A), the process moves to operation 528 shown in FIG. 4B, where the control unit 60 detects the rise rate (Wa) of the wash water temperature rising with time and compares the rise rate (Wa) of the wash water temperature with a predetermined reference rise rate range (Wa1) to (Wa2) (1 to 30 per minute).

From operation 528, the process moves to operation 530, where it is determined whether the detected rise rate (Wa) of the wash water is lower than or equal to the reference rise rate range (Wa1) to (Wa2). When it is determined that the detected rise rate (Wa) of the wash water temperature is lower than the reference rise rate range (Wa1) to (Wa2) in operation 530, which means that a small amount of wash water has been absorbed by laundry, and therefore, the amount of wash water is large, the process moves to operation 532, where the control unit 60 increases motor-on time A3 (i.e., A1×1.2) and washing time C3 (i.e., C1×1.2), which are obtained by multiplying the firstly changed motor-on time A1 and the firstly changed washing time (C1) by 1.2 such that optimal washing is accomplished even when the rise rate of the wash water temperature is low.

When the rise rate (Wa) of the wash water temperature is within the reference rise rate range (Wa1) to (Wa2) in operation 534, the process moves to operation 536, where the motor-on time (A3) and the washing time (C3) of the next algorithm are set to satisfy A3=A1 and C3=C1 without changing the firstly changed motor-on time (A1) and the firstly changed washing time (C1).

On the other hand, when the rise rate (Wa) of the wash water temperature is higher than the reference rise rate range (Wa1) to (Wa2) in operation 534, which means that a large amount of wash water has been absorbed by laundry, and therefore, the amount of wash water is small, the process moves to operation 538, where the control unit 60 decreases the motor-on time (A3) (i.e., A1×0.8) and the washing time (C3) (i.e., C1×0.8), which are obtained by multiplying the firstly changed motor-on time A1 and the firstly changed washing time (C1) by 0.8 such that energy is saved with reduced damage to laundry when the rise rate of the wash water temperature is high.

From operations 532, 536 or 538, the process moves to operation 540, where while the washing is performed based on the algorithm (the motor-on time A1 and the washing time (C1)) firstly changed depending upon the initial water temperature (To), the algorithm (the motor-off time (B2)) secondly changed depending upon the temperature drop generated during the motor-off time, or the algorithm (the motor-on time (A3) and the washing time (C3)) thirdly changed depending upon the rise rate (Wa) of the wash water temperature as described above, in the case of heated washing, the process moves to operation 542, where the control unit 60 detects the wash water temperature (Tw) and resets motor-on time A4 every temperature step depending upon the change of the wash water temperature (Tw).

When the detected wash water temperature (Tw) is lower than a first predetermined reference temperature (T1) (i.e., a minimum temperature suitable for the laundry to be washed with heated wash water, approximately 40°) in operation 544, the process returns to operation 528, such that operation 528 can be repeated, until the wash water temperature reaches the first reference temperature (T1).

When the wash water temperature (Tw) is not lower than the first predetermined reference temperature (T1) in operation 544, the process moves to operation 546, where the wash water temperature (Tw) is compared with a second predetermined reference temperature range (T1) to (T2) (40 to 50°). When the wash water temperature (Tw) is within the second reference temperature range (T1) to (T2), the control unit 60 decreases the motor-on time (A4) (i.e., A3×0.9), which is obtained by multiplying the thirdly changed motor-on time (A3) by 0.9 such that the machine force is reduced in operation 548.

When the wash water temperature (Tw) is not within the second reference temperature range (T1) to (T2), the wash water temperature (Tw) is compared with a third predetermined reference temperature range (T2) to (T3) (50 to 60°) in operation 550. When the wash water temperature (Tw) is within the third reference temperature range (T2) to (T3), the control unit 60 decreases the motor-on time (A4) (i.e., A3×0.8), which is obtained by multiplying the thirdly changed motor-on time (A3) by 0.8 such that the machine force is further reduced in operation 552.

When the wash water temperature (Tw) is not within the third reference temperature range (T2) to (T3), the wash water temperature (Tw) is compared with a fourth predetermined reference temperature range (T3) to (T4) (60 to 70°) in operation 554. When the wash water temperature (Tw) is within the fourth reference temperature range (T3) to (T4), the control unit 60 decreases the motor-on time (A4) (i.e., A3×0.7), which is obtained by multiplying the thirdly changed motor-on time (A3) by 0.7 such that the machine force is still further reduced in operation 556.

When the wash water temperature (Tw) is not within the fourth reference temperature range (T3) to (T4), the wash water temperature (Tw) is compared with a fourth predetermined reference temperature (T4) (70°) in operation 558. When the wash water temperature (Tw) is greater than the fourth reference temperature (T4), the control unit 60 decreases the motor-on time (A4) (i.e., A3×0.6), which is obtained by multiplying the thirdly changed motor-on time (A3) by 0.6 such that the machine force is still further reduced in operation 560.

In other words, in the case of a delicate washing course (a washing course performed to mainly reduce damage to laundry), which requires a large amount of wash water as compared to the weight of laundry, the control unit 60 decreases the motor-on time (A4) to reduce the machine force as the wash water temperature (Tw) rises, thereby reducing the damage to laundry.

As described above, the washing is performed based on the algorithm (the motor-on time (A1) and the washing time (C1)) firstly changed depending upon the initial water temperature To, the algorithm (the motor-off time (B2)) secondly changed depending upon the temperature drop generated during the motor-off time, the algorithm (the motor-on time (A3) and the washing time (C3)) thirdly changed depending upon the rise rate Wa of the wash water temperature, or the algorithm (the motor-on time (A4)) fourthly changed depending upon the change of the wash water temperature (Tw) in operation 562. When the washing operation has been completed in operation 564, the process moves to operation 700 shown in FIG. 3, to perform rinsing and spin-drying operations. When the washing operation has not been completed, the process returns to operation 518.

The washing control method performed based on the temperature detection in the case of delicate washing has been described with reference to FIGS. 4A and 4B. Hereinafter, a method of executing algorithm to change motor operation rate and washing time based on temperature detection in the case of normal washing will be described with reference to FIGS. 5A and 5B.

The normal washing course differs little from the delicate washing course. However, the motor-off time of the normal washing is shorter than that of the delicate washing, and therefore, a process to check the temperature drop caused during the motor-off time is omitted. Furthermore, the normal washing is performed to mainly improve washing efficiency unlike the delicate washing. Consequently, the normal washing is different from the delicate washing in that, motor-on time (A33) is increased as wash water temperature (Tw) rises, thereby increasing the machine force and improving the washing efficiency.

Figure 5A:
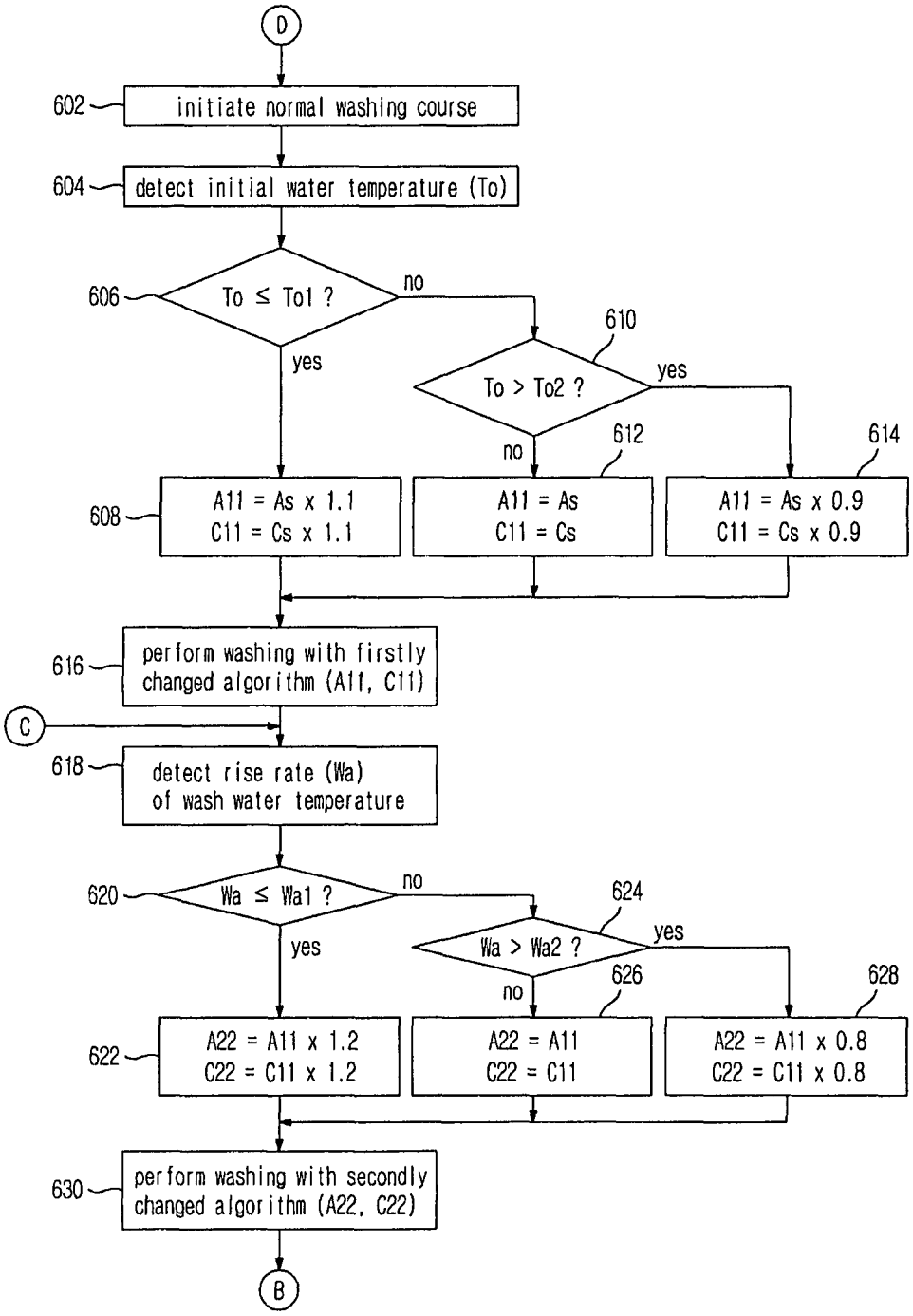
FIGS. 5A and 5B are flow charts illustrating a washing control method based on temperature detection in a normal washing course of the washing machine according to an embodiment of the present invention.
Figure 5B:
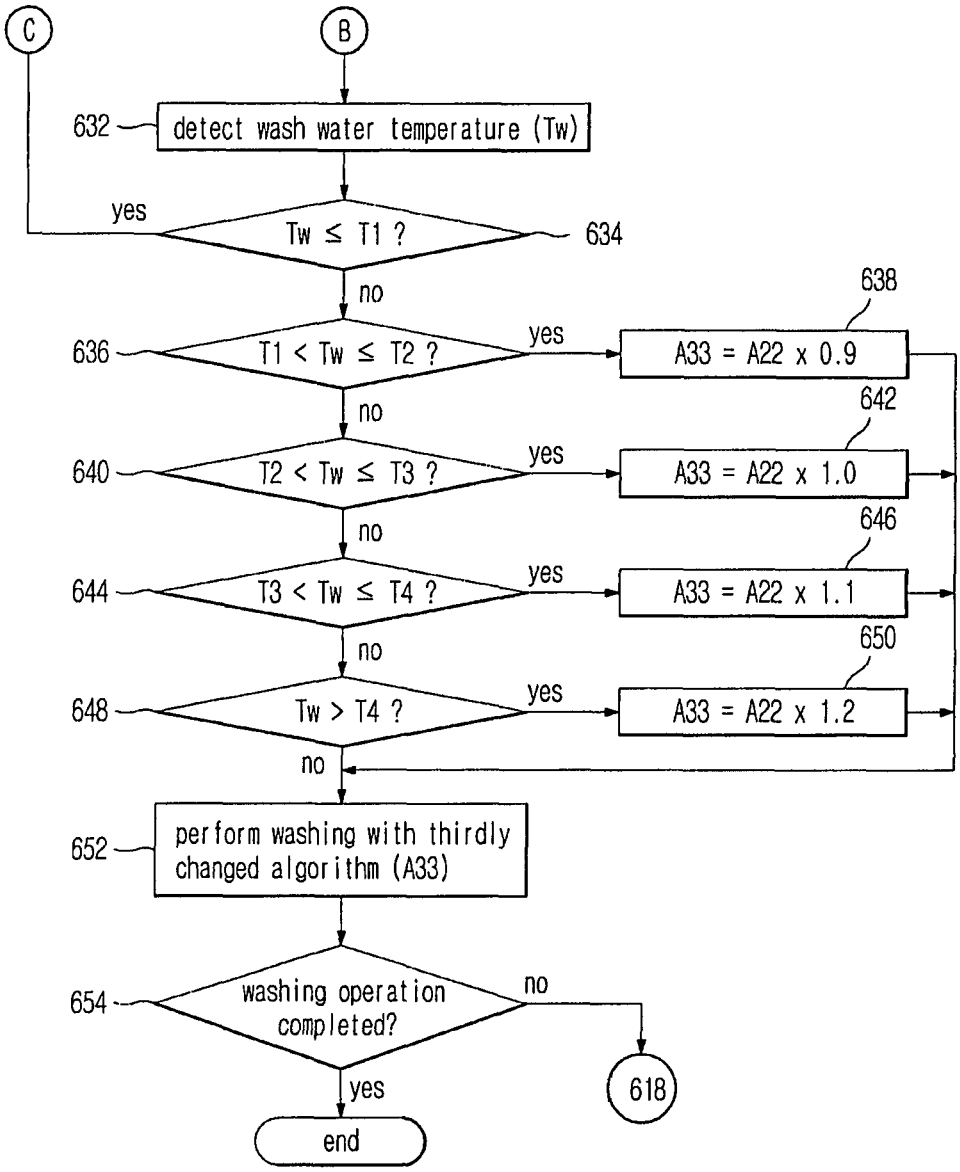

FIGS. 5A and 5B are flow charts illustrating a washing control method based on temperature detection in a normal washing course of the washing machine according to an embodiment of the present invention. Operations of the normal washing course corresponding to those of the delicate washing course are denoted by the same reference numerals and the same terms, and a detailed description thereof will not be given.

First, it is determined whether the washing course selected by the user (see operation 501 in FIG. 4A) is a delicate washing course. When it is determined that the selected washing course is not the delicate washing course, i.e., it is determined that the selected washing course is a normal washing course, a washing operation of the normal washing course is initiated based on the reference motor-on time (As), the motor-off time (Bs), and the reference washing time (Cs) set depending upon the amount of load (i.e., weight of the laundry) in operation 602.

When the washing operation of the normal washing course is initiated, the control unit 60 detects the temperature of wash water supplied in the beginning of washing (initial water temperature) (To) through the temperature sensor 30 in operation 604 and compares the detected temperature with the reference water temperature range (To1) to (To2).

When the detected initial water temperature (To) deviates from the reference water temperature range (To1) to (To2) (i.e., (To) is lower than (To1)) in operation 606, the process moves to operation 608, where the control unit 60 increases motor-on time (A11) (i.e., As×1.1) and washing time (C11) (i.e., Cs×1.1), which are obtained by multiplying the reference motor-on time (As) and the reference washing time (Cs) by 1.1 such that optimal washing is accomplished.

When the initial water temperature (To) is within the reference water temperature range (To1) to (To2) in operation 610, the process moves to operation 612, where the motor-on time (A11) and the washing time (C11) are set to satisfy A11=As and C11=Cs without changing the reference motor-on time (As) and the reference washing time (Cs).

When the initial water temperature (To) deviates from the reference water temperature range (To1) to (To2) (i.e., To is higher than To2) in operation 610, the process moves to operation 614, where the control unit 60 decreases the motor-on time (A11) (i.e., As×0.9) and the washing time (C11) (i.e., Cs×0.9), which are obtained by multiplying the reference motor-on time As and the reference washing time (Cs) by 0.9 such that energy is saved with reduced damage to laundry.

While the washing is performed with the algorithm firstly changed based on the initial water temperature (To) in operation 616, the amount of wash water varies depending upon the material of the laundry, although the amount of load is the same. Since time necessary for wash water temperature to rise to a desired wash water temperature varies due to the change of the amount of wash water, the control unit 60 detects the wash water temperature for a predetermined time (i.e., a minimum time for which the rise rate of the wash water temperature can be detected) during washing.

Subsequently, in operation 618, the control unit 60 detects the rise rate (Wa) of the wash water temperature rising with time and compares the rise rate (Wa) of the wash water temperature with the predetermined reference rise rate range (Wa1) to (Wa2).

When the detected rise rate (Wa) of the wash water temperature is lower than the reference rise rate range Wa1 to Wa2 in operation 620, which means that the amount of wash water is large, the process moves to operation 622, where the control unit 60 increases motor-on time (A22) (i.e., A11×1.2) and washing time (C22) (i.e., C11×1.2), which are obtained by multiplying the firstly changed motor-on time (A11) and the firstly changed washing time (C11) by 1.2 such that optimal washing is accomplished.

When the rise rate (Wa) of the wash water temperature is within the reference rise rate range (Wa1) to (Wa2) in operation 624, the process moves to operation 626, where the motor-on time (A22) and the washing time (C22) are set to satisfy A22=A11 and C22=C11 without changing the firstly changed motor-on time (A11) and the firstly changed washing time (C11).

When the rise rate (Wa) of the wash water temperature is higher than the reference rise rate range (Wa1) to (Wa2) in operation 624, which means that the amount of wash water is small, the process moves to operation 628, where the control unit 60 decreases the motor-on time (A22) (i.e., A11×0.8) and the washing time (C22) (i.e., C11×0.8), which are obtained by multiplying the firstly changed motor-on time (A11) and the firstly changed washing time (C11) by 0.8 such that energy is saved with reduced damage to laundry.

While the washing is performed based on the algorithm (the motor-on time (A11) and the washing time (C11)) firstly changed depending upon the initial water temperature (To) or the algorithm (the motor-on time (A22) and the washing time (C22)) secondly changed depending upon the rise rate (Wa) of the wash water temperature as described above in operation 630, in the case of heated washing, the process moves to operation 632 shown in FIG. 5B, where the control unit 60 detects the wash water temperature (Tw) and resets motor-on time (A33) at every temperature step depending upon the change of the wash water temperature (Tw).

When the detected wash water temperature (Tw) is lower than a first reference temperature (T1) (a minimum temperature to which wash water is heated, approximately 40°) in operation 634, the process returns to operation 618, such that operation 618 can be repeated, until the wash water temperature reaches the first reference temperature (T1).

When the wash water temperature (Tw) is not lower than the first predetermined reference temperature (T1), the wash water temperature (Tw) is compared with a second reference temperature range T1 to T2 (40 to 50°) in operation 636. When the wash water temperature (Tw) is within the second reference temperature range (T1) to (T2), the process moves to operation 638, where the control unit 60 decreases motor-on time (A33) (i.e., A22×0.9), which is obtained by multiplying the secondly changed motor-on time (A22) by 0.9 such that the machine force is reduced.

When the wash water temperature (Tw) is not within the second predetermined reference temperature range (T1) to (T2), the wash water temperature Tw is compared with a third reference temperature range (T2) to (T3) (50 to 60°) in operation 640. When the wash water temperature (Tw) is within the third reference temperature range (T2) to (T3), the process moves to operation 642, where the control unit 60 maintains the motor-on time (A33) (i.e., A22×1.0), which is obtained by multiplying the secondly changed motor-on time (A22) by 1.0 such that the machine force is not changed.

When the wash water temperature (Tw) is not within the third reference temperature range (T2) to (T3), the wash water temperature (Tw) is compared with a fourth predetermined reference temperature range (T3) to (T4) (60 to 70°) in operation 644. When the wash water temperature (Tw) is within the fourth reference temperature range (T3) to (T4), the process then moves to operation 646 where the control unit 60 increases the motor-on time (A33) (i.e., A22×1.1), which is obtained by multiplying the secondly changed motor-on time (A22) by 1.1 such that the machine force is increased.

When the wash water temperature (Tw) is not within the fourth reference temperature range (T3) to (T4), the wash water temperature (Tw) is compared with a fourth predetermined reference temperature (T4) (70°) in operation 648. When the wash water temperature (Tw) is greater than the fourth reference temperature (T4), the process moves to operation 650, where the control unit 60 increases the motor-on time (A33) (i.e, A22×1.2), which is obtained by multiplying the secondly changed motor-on time (A22) by 1.2 such that the machine force is further increased.

In other words, in the case of a normal washing course (a washing course performed to mainly improve the washing efficiency), the control unit 60 increases the motor-on time (A33) to increase the machine force as the wash water temperature (Tw) rises, thereby maximally improving the washing efficiency.

As described above, the washing is performed based on the algorithm (the motor-on time (A11) and the washing time (C11)) firstly changed depending upon the initial water temperature (To), the algorithm (the motor-on time (A22) and the washing time (C22)) secondly changed depending upon the rise rate (Wa) of the wash water temperature, or the algorithm (the motor-on time (A33)) thirdly changed depending upon the change of the wash water temperature (Tw) in operation 652. When the washing operation has been completed in operation 654, the process advances to operation 700 as shown in FIG. 3, to perform rinsing and spin-drying operations. When the washing operation has not been completed, the process returns to operation 618 as shown in FIG. 5A.

As apparent from the above description, the washing machine and the washing control method of the same according to embodiments of the present invention control a degree of application of the machine force every temperature step according to the selected washing course based on information, such as the amount of load detected in the beginning of washing and the amount of wash water detected by the rise change of the wash water temperature during washing. Consequently, the present invention has the effect of reducing damage to laundry during washing and accomplishing optimal washing efficiency.

Also, the initial washing temperature and the change of wash water temperature in the heating section 5 are detected. Consequently, the present invention has the effect of accomplishing uniform mixture of wash water during heating of the wash water and reducing damage to laundry.

Furthermore, optimal heating and machine force application are achieved every temperature step in consideration of the load of the washing machine and the rise rate of the wash water temperature generated due to the change in the amount of wash water depending upon the difference in material of the laundry. Consequently, the present invention has the effect of accomplishing effective washing of laundry requiring delicate washing and saving energy through the change of operation rate and washing time by the temperature detection.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing control method of a washing machine, comprising:

detecting wash water temperature several times; and adjusting at least one of a motor operation rate and a washing time based on the detected wash water temperature, wherein the detecting the wash water temperature several times comprises detecting a temperature of wash water supplied in an initial operation of washing, detecting a rise rate of the wash water temperature which varies according to a material of laundry, and detecting a wash water temperature variation during washing, and wherein the adjusting at least one of the motor operation rate and the washing time comprises decreasing motor-on time and the washing time when the rise rate of the wash water temperature is higher than a reference rise rate of the wash water temperature and increasing the motor-on time and the washing time when the rise rate of the wash water temperature is lower than the reference rise rate of the wash water temperature, and changing the motor-on time at every temperature step based on a selected wash course.

2. The washing control method according to claim 1, wherein the adjusting at least one of the motor operation rate and the washing time further comprises comparing the temperature of wash water supplied in the initial operation of the washing with a predetermined reference water temperature to decrease motor-on time and the washing time when the initial wash water temperature is higher than the reference water temperature, and to increase the motor-on time and the washing time when the initial wash water temperature is lower than the reference water temperature.

3. The washing control method according to claim 1, wherein the changing the motor-on time at every temperature step comprises decreasing the motor-on time as the wash water temperature rises in the case of delicate washing and increasing the motor-on time as the wash water temperature rises in the case of normal washing.

4. The washing control method according to claim 1, wherein the detecting the wash water temperature several times during the washing operation further comprises detecting a drop of the wash water temperature during motor-off time.

5. The washing control method according to claim 4, wherein the adjusting at least one of the motor operation rate and the washing time comprises checking the drop of the wash water temperature during the motor-off time to decrease the motor-off time when the temperature drop has occurred for more than a predetermined time.

6. The washing control method according to claim 4, wherein the detecting the drop of the wash water temperature during the motor-off time comprises detecting the wash water temperature during the motor-off time to check temperature drop in which a wash water temperature rising and dropping section continues for a predetermined period time.

* * * * *